United States Patent [19]

South

[11] Patent Number: 4,709,809

[45] Date of Patent: Dec. 1, 1987

[54] BOTTLE CARRIER

[75] Inventor: Alan C. South, Willingham, England

[73] Assignee: R. W. Simon Limited, Devon, England

[21] Appl. No.: 899,159

[22] Filed: Aug. 22, 1986

[51] Int. Cl.[4] ..... B65D 5/36; B65D 5/64; B65D 33/06; B65D 30/22

[52] U.S. Cl. ..... 206/162; 206/200; 383/25; 383/39

[58] Field of Search ..... 206/144, 162, 170, 174, 206/176, 178, 192, 200, 428, 431, 443; 229/52 B, 52 C, 114; 383/25, 39; 211/74; 294/149

[56] References Cited

U.S. PATENT DOCUMENTS

| | | | |
|---|---|---|---|
| 2,405,517 | 8/1946 | Plummer | 206/162 |
| 2,473,429 | 6/1949 | Hinman | 206/162 |
| 3,815,758 | 6/1974 | Vandergeeten | 211/74 |
| 4,299,324 | 11/1981 | Dickens | 206/170 |
| 4,326,526 | 4/1982 | Buck et al. | 206/174 X |

FOREIGN PATENT DOCUMENTS

| | | | |
|---|---|---|---|
| 119778 | 10/1918 | United Kingdom | 383/25 |

*Primary Examiner*—Stephen Marcus
*Attorney, Agent, or Firm*—Quaintance, Murphy & Presta

[57] ABSTRACT

A carrier (10) for a bottle comprises a plurality of containers (11) each having side walls (12,13,15,16) upstanding from a corresponding basal edge (19,20,21,22) of an inverted pyramidal base portion (18). When a bottle is received in a container (11), weight of the bottle causes walls (23) of the base portion (18) thereof to diverge one from another with a result that the side walls (12,13,15,16) converge towards and firmly engage the bottle.

9 Claims, 3 Drawing Figures

BOTTLE CARRIER

Figure 1:
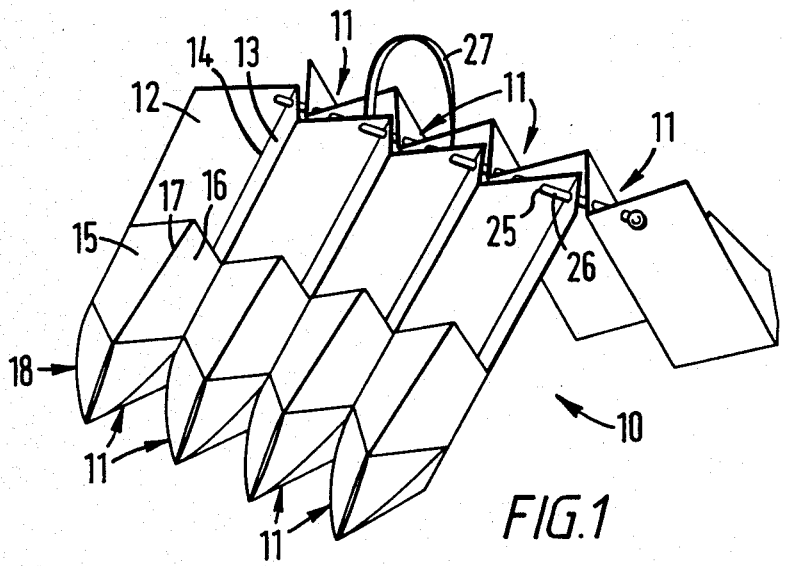

This invention relates to a bottle carrier.

Since bottles generally are of a configuration in which an outer circumferential surface is curved and a diameter of a base is considerably less than an overall height, bottles are inherently unstable when transported unless provided with support. Transportation of bottles in small quantities generally is effected by inserting the bottles in a carrier bag. However, bags generally are unsuited to transportation of bottles because, being of flexible material, they do not provide vertical support for bottles. In consequence, when bags containing bottles are deposited, there is a tendency for the bottles contained in the bags to topple causing the bag and the contents thereof also to topple. Furthermore, the flexible material of carrier bags provides little protection in the event of a bag containing bottles being dropped. Since most bottles are made of glass, impact with another object of a bag containing bottles is likely to result in one or more of the bottles being broken.

Although it is well known to provide containers for bottles which do provide vertical support for the bottles, such containers generally are intended for single use and are not generally suited for transportation by hand.

It is desirable, therefore, to provide a carrier for a bottle which provides vertical support for the bottle, which easily can be transported by hand when containing a bottle and which may be used repeatedly for transporting successive bottles.

According to the present invention there is provided a carrier for a bottle comprising a container having opposite facing side walls and a base portion united with the side walls, the base portion having downwardly converging walls arranged such that, when a bottle is received in the container, weight of the bottle causes the walls of the base portion to diverge one from another and the side walls to converge towards the bottle.

The base portion may comprise an inverted pyramid configuration.

The configuration may comprise edges adjacent the side walls which edges define a square.

The carrier may comprise a plurality of containers each suspended from an elongate member extending adjacent upper portions of the side walls.

The containers may be pivotable relative to the elongate member on a longitudinal axis of the member.

The member may extend through the side walls of the containers.

The member may be provided with a handle.

Following is a description, by way of example only and with reference to the accompanying drawings, of one method of carrying the invention into effect.

Figure 2:
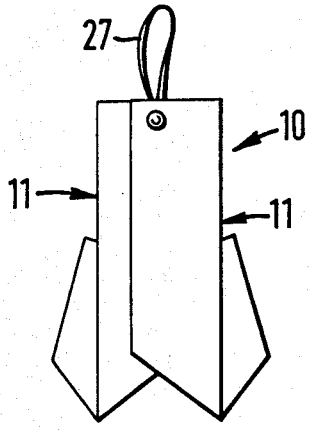
Figure 3:
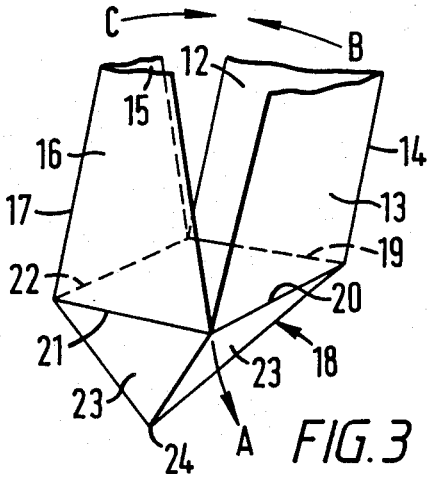

In the drawings:

FIG. 1 is a perspective view of a carrier for bottles comprising a plurality of containers in accordance with the present invention, the containers being linked one with another to form the carrier and the carrier being shown in a condition when supported on a surface, FIG. 2 is an end elevation of the carrier when suspended from a handle thereof, and FIG. 3 is a diagrammatic representation of a container in accordance with the present invention indicating forces applied to surfaces of the container when a bottle is inserted therein.

Referring now to FIGS. 1 and 2 of the drawings, there is shown a carrier 10 comprising a plurality of elongate containers 11 each for containing a corresponding one of a plurality of bottles (not shown) such that a central longitudinal axis of each bottle extends substantially parallel to a central longitudinal axis of a corresponding one of the containers 11.

Each container 11 comprises a pair of elongate rectangular rear panels 12,13 united one with another along a common longitudinal marginal edge 14 and a pair of elongate rectangular front panels 15,16 united one with another along a common longitudinal marginal edge 17. Each container 11 also comprises a base portion 18 in the form of an inverted pyramid of square base defined by rectilinear edges 19,20,21 and 22 from which outer surfaces 23 of the base portion 18 downwardly converge towards one another at an apex 24 whereby the surfaces 23 are inclined upwardly from the apex 24 to the edges 19,20,21 and 22. The edges 19,20,21 and 22 are united with adjacent lower marginal edges of the panels 12, 13, 15 and 16 respectively.

The rear panels 12, 13 are of greater longitudinal dimension than the front panels 16 and 15 and each is provided at an upper portion thereof with an aperture 25 through which extends an elongate rod 26. The rod 26 has located thereon a handle 27.

In the embodiment illustrated in FIG. 1, the rod 26 has located thereon eight containers 11 arranged in two rows in back-to-back configuration, the containers of one row being alternate with the containers of the other row in a longitudinal direction of the rod 26.

In use, one or more bottles (not shown) may be carried in the carrier 10 by inserting each bottle longitudinally in a downward direction of a corresponding container 11 between the rear panels 12,13 and the front panels 15, 16. The bottles in the carrier 10 may be transported by grasping and lifting the handle 27 whereby the containers 11 pivot in a plane extending transversely of the longitudinal axis of the rod 26 until the rows of containers 10 nestle with respect of one another in a substantially vertical condition suspended from the rod 26, as shown in FIG. 2.

When the carrier 10 is lowered onto a surface and the handle 27 released, the rows of containers 11 splay outwardly one from another in a direction downwardly from the rod 26 due to the downward force exerted by the weight of the bottles in the carrier 10 and the downwardly converging surfaces 23 of the base portions 18 of the containers 11. Movement of the rows of containers relative one to another is stablised when an outer surface 23 of the base portion of each of the containers 11 is substantially wholly in contact with a surface supporting the carrier 10 and the forces tending to tilt the containers 11 rearwardly being neutralised in the two rows of containers 11. The carrier 10 thus seats in a substantially stable condition on the surface, as shown in FIG. 1, with the bottles contained therein reclining in rows in back-to-back configuration.

It will be appreciated that, with a container in accordance with the present invention, most bottles can be accommodated without having to provide containers 11 of different dimensions. In FIG. 3, there is shown a diagrammatic representation of a lower portion of a container 11 from which it will be apparent that, when a bottle is located therein, the weight of the bottle causes a downward force indicated by arrow A on the inverted pyramid base portion 23 tending to deform the walls 23 outwardly. Such outward deformation results in upper portions of the rear panels 12,13 and upper portions of the front panels 15,16 tending to move towards one another, as indicated by the arrows B and C in FIG. 3, resulting in the upper portions of the panels 12, 13, 15 and 16 tending to embrace a bottle contained between the panels. Therefore, different bottles of different longitudinal dimensions and transverse dimension would be firmly held in each container 11.

I claim:

1. A carrier (10) for a bottle comprising a container (11) having opposite facing side walls (12,13,15,16) and a base portion (18) united with the side walls (12,13,15,16), the base portion (18) having downwardly converging walls (23) arranged such that, when a bottle is received in the container (11), weight of the bottle causes the walls (23) of the base portion (18) to diverge one from another and the side walls (12,13,15,16) to converge towards the bottle, there being a plurality of containers (11) each suspended from an elongate member (26) extending adjacent upper portions of the side walls (12,13).

2. A carrier (10) as claimed in claim 1 characterised in that the base portion (18) comprises inverted pyramid configuration.

3. A carrier (10) as claimed in claim 2 characterised in that the configuration comprises edges (19,20,21,22) adjacent the side walls (12,13,16,15) which edges define a square.

4. A carrier (10) as claimed in claim 2 characterised in that the containers (11) are pivotable relative to the elongate member (26) on a longitudinal axis of the member (26).

5. A carrier (10) as claimed in claim 3 characterised in that the containers (11) are pivotable relative to the elongate member (26) on a longitudinal axis of the member (26).

6. A carrier (10) as claimed in claim 1 characterised in that the containers (11) are pivotable relative to the elongate member (26) on a longitudinal axis of the member (26).

7. A carrier (10) as claimed in claim 1 characterised in that the member (26) extends through the side walls (12,13) of the containers (11).

8. A carrier (10) as claimed in claim 1 characterised in that the member (26) extends through the side walls (12,13) of the containers (11).

9. A carrier (10) as claimed in claim 1 characterised in that the member (26) is provided with a handle (27).

* * * * *